US007140747B2

(12) United States Patent
Yang

(10) Patent No.: US 7,140,747 B2
(45) Date of Patent: Nov. 28, 2006

(54) FOCUSING FLASHLIGHT

(75) Inventor: Manho Yang, Guandong (CN)

(73) Assignee: Ascent Fair (Hong Kong) Limited, Hong Kong (HK)

( * ) Notice: Subject to any disclaimer, the term of this patent is extended or adjusted under 35 U.S.C. 154(b) by 0 days.

(21) Appl. No.: 10/510,176

(22) PCT Filed: Apr. 3, 2003

(86) PCT No.: PCT/CN02/00585

§ 371 (c)(1),
(2), (4) Date: Mar. 29, 2005

(87) PCT Pub. No.: WO03/083358

PCT Pub. Date: Oct. 9, 2003

(65) Prior Publication Data

US 2005/0168978 A1 Aug. 4, 2005

(30) Foreign Application Priority Data

Apr. 3, 2002 (CN) ..... 02 2 26592

(51) Int. Cl.
*F21L 4/00* (2006.01)

(52) U.S. Cl. ..... 362/202; 362/188; 362/199; 362/208

(58) Field of Classification Search ..... 362/202, 362/187, 188, 197, 199, 208, 649, 650, 428, 362/429

See application file for complete search history.

(56) References Cited

U.S. PATENT DOCUMENTS 1,408,528 A * 3/1922 Lyhne ..... 362/188
1,751,432 A * 3/1930 Voorhees ..... 361/187

* cited by examiner

*Primary Examiner*—Sandra O'Shea
*Assistant Examiner*—Sharon Payne
(74) *Attorney, Agent, or Firm*—Baker & Hostetler LLP

(57) ABSTRACT

The invention involves a focusing flashlight, the flashlight includes the tail cover, housing body, and a reflector and a bulb holder installed in the housing body. Therein, the reflector and the bulb holder are connected to each other by the threads in order to adjust the position of the bulb. Between the reflector and the bulb holder, there is installed a lock device to fix the relative position of the reflector and the bulb holder. The focusing flashlight has a lot of advantages, for example, the focusing performance being reliable, the focusing performance after focusing being unaffected by the rotation of the front cover and the housing head, the structure being simple, and convenient.

24 Claims, 4 Drawing Sheets

FOCUSING FLASHLIGHT

FIELD OF THE INVENTION

The present invention relates to a focusing flashlight.

BACKGROUND OF THE INVENTION

The common flashlights can be classified into focusing flashlights and unfocusing flashlights depending on whether the flashlights can focus or not. The focusing flashlights generally perform the focusing by rotating the housing head or the front cover to allow the luminous point of the bulb and the focus of the parabolic reflector to coincide. However, this kind of focusing flashlight has a disadvantage that when the user rotates the housing head or the front cover unconsciously and the focus of the reflector mismatches with the lighting point of the bulb, the lights scatter, and a readjustment of focusing is needed. Unfocusing flashlights fix the relative positions of the reflector and the bulb. The bulbs of some unfocusing flashlights cannot be replaced whereas some others can be replaced. Even if the bulb can be replaced, the flashlight with the replaced bulb is not focused because the actual height of the filament in each bulb is somewhat variable.

SUMMARY OF THE INVENTION

The present invention is directed to overcome the above-mentioned disadvantages of the prior flashlights and provides a focusing flashlight which enables the relative position of the luminous point of the bulb to the parabolic focus allows, the reflector to be adjusted. After the assembly is completed, the positions of the bulb and the reflector are relatively fixed. Thus the focusing performance of the light is not affected by the rotation of the front cover or the housing head.

In order to realize the above advantages, the present invention provides a focusing flashlight, the flashlight, includes the tail cover, housing body, a reflector and a bulb holder installed on the housing body. The reflector and the bulb holder are connected to each other by the screw threads to adjust the position of bulb. Between the reflector and the bulb holder, is a lock device to fix the relative positions of the reflector and the bulb holder. The focusing flashlight according to the invention has a lot of advantages compared with the prior art. For example, the focusing performance is reliable and unaffected by the rotation of the front cover and the housing head after focusing. This structure is simple, and has convenient operation.

There has thus been outlined, rather broadly, certain embodiments of the invention in order that the detailed description thereof herein may be better understood, and in order that the present contribution to the art may be better appreciated. There are, of course, additional embodiments of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of embodiments in addition to those described and of being practiced and carried out in various ways. Also, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION

Figure 1:
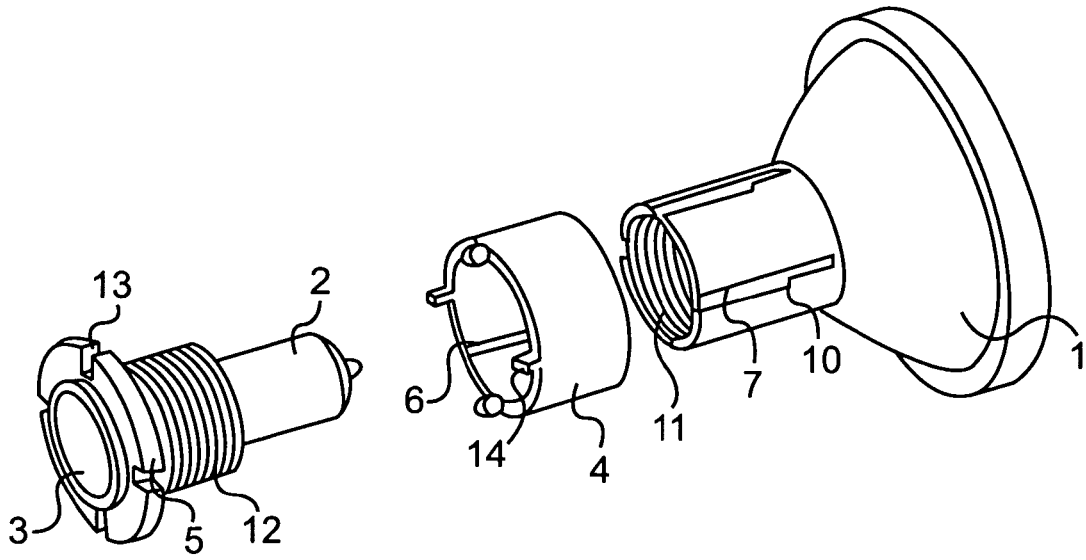
FIG. 1 is a perspective exploded view of the focusing flashlight according to one of the embodiments of the invention, wherein only the reflector, the lock device and the bulb holder are shown.

The preferred embodiments of the present invention will now be discussed in detail with reference to the accompanying drawings. According to the present invention, the flashlight includes a tail cover, a housing body, batteries in the housing body, and a reflector. A lock device and a bulb holder are assembled together and then mounted on the housing body. FIG. 1 shows an exploded view of the focusing flashlight according to an embodiment of the present invention, wherein only the reflector 1, the lock device 4 and the bulb holder are shown. As shown in FIG. 1, the reflector 1 has a parabolic lampshade and a barrel portion 10 integrally attached to the top end of the lampshade. The inner screw threads 11 are formed on the inner wall of the barrel portion 10 of the reflector 1 and the grooves 7 elongated along the axial direction of the barrel portion 10 are formed on the outer wall at equal intervals in the circumference direction. The grooves 7 do not penetrate the wall of the barrel portion 10 and the width of the grooves 7 is not uniform, with the portion of the grooves near the lampshade being relatively smaller than that near the free end. The portion with the larger width can extend in the circumference direction to either one of or both sides relative to the narrower portion.

The lock device 4 is a cylindrical part with an inside diameter approximately equivalent to the outside diameter of the barrel portion 10 of the reflector 1. The protruding ribs 6 are formed in the axial direction on the inner wall of the lock device 4 at equal intervals to be engaged with the grooves 7 of the barrel portion 10 of the reflector 1, and the height of the protruding ribs is approximately equal to the depth of the grooves 7. The projections 14 project in the axial direction from the end of the lock device 4 away from the reflector 1 at equal intervals. The number of the grooves 7 formed on the reflector 1 is the same as or an integral multiple of the number of the protruding ribs 6 formed on the lock device 4.

The bulb holder comprises a bulb-holding base 5 and a bulb-inserting base 3. The bulb-holding base 5 is formed in the shape of a hollow cylinder and has a flange on one of its ends. The bulb-inserting base 3 with bulb 2 installed therein is inserted into the hollow portion of the bulb-holding base 5. The outer screw threads 12 are formed on the outer wall of the cylindrical portion of the bulb-holding base 5 to be engaged with the inner screw threads 11 formed on the inner wall of the barrel portion 10 of the reflector 1, and a plurality of recesses 13 corresponding to the projections 14 of the lock device 4 are formed on the flange of the bulb-holding base 5 at equal intervals in the circumference direction. The number of the recesses 13 formed on the flange of the bulb-holding base 5 is the same as or an integral multiple of the number of the projections 14 formed on the lock device 4.

Figure 2:
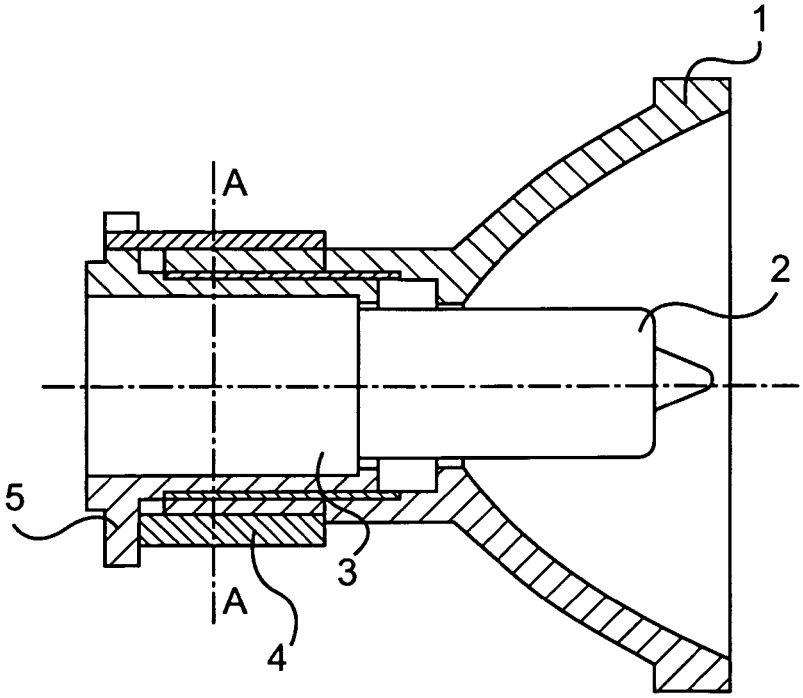
FIG. 2 shows schematically the assembly of the reflector, the lock device and bulb holder of FIG. 1.
Figure 3:
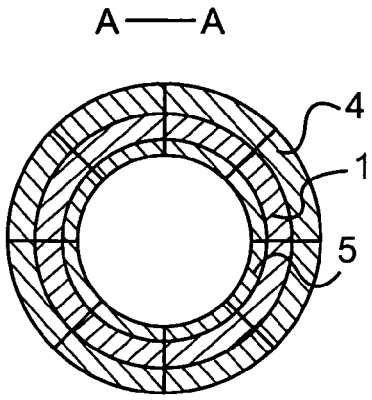
FIG. 3 is a cross-sectional view taken along the line A—A in FIG. 2.

FIG. 2 shows schematically the assembly of the reflector, the lock device and the bulb holder in FIG. 1. FIG. 3 is a sectional view taken along the line A—A in FIG. 2. In assembling, the protruding ribs 6 are inserted into the grooves 7 of the barrel portion 10 of the reflector 1 so that the lock device 4 is set around the exterior of the barrel portion 10 of the reflector. Then, the bulb holder is mounted on the reflector 1 by screwing the outer screw threads 12 of the bulb-holding base 5 on the inner screw threads 11 of the reflector 1.

Figure 4:
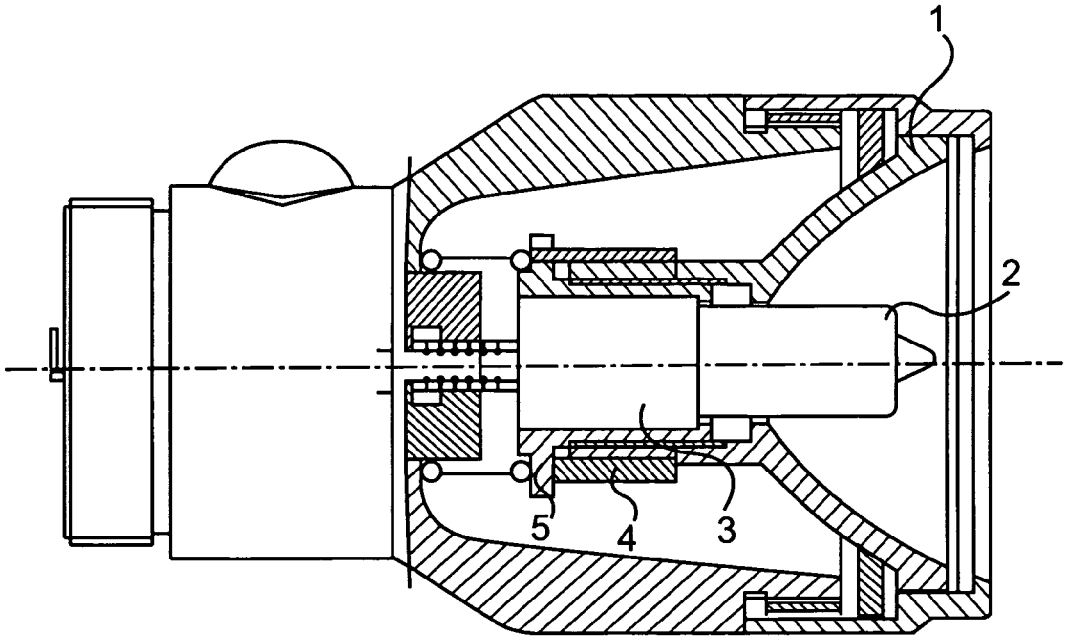
FIG. 4 shows schematically the reflector, the lock device and the bulb holder mounted on the housing body of the flashlight.

FIG. 4 shows schematically the reflector, the lock device and the bulb holder which are mounted on the housing body of the flashlight. After the reflector, the lock device and the bulb holder are assembled, they can be installed integrally on the housing body of the flashlight to form an integrated flashlight.

Figure 5:
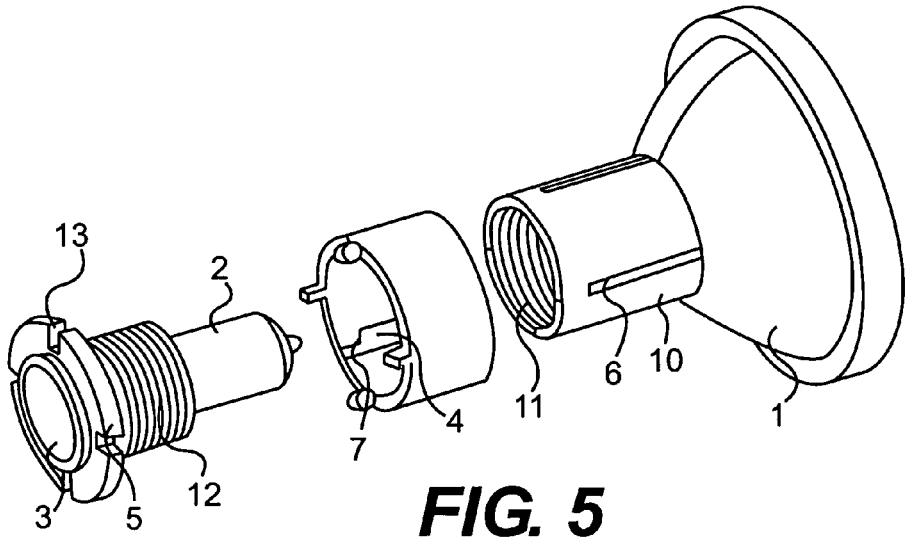
FIG. 5 is the perspective exploded view of the focusing flashlight according to another embodiment of the present invention, wherein only the reflector, the lock device and the bulb holder are shown.

FIG. 5 is an exploded view of the focusing flashlight according to another embodiment of the present invention, wherein only the reflector, the lock device and the bulb holder are shown. This embodiment is similar to the first embodiment, except that the positions of the protruding ribs 6 and the grooves 7 are varied Here the protruding ribs 6 are formed in the axial direction on the outer wall of the barrel portion 10 of the reflector 1 at equal intervals, and the grooves 7 to be engaged with the protruding ribs 6 are formed on the inner wall of the lock device 4 at equal intervals in the circumference direction. The width of the grooves 7 is not uniform, with the end near the bulb holder being narrower and the end near the reflector 1 growing wider.

During focusing, after the bulb 2 is installed, the lock device 4 coupled with the barrel portion 10 of the reflector 1 is installed, the lock device 4 coupled with the barrel portion 10 of the reflector 1 is firstly slid toward the lampshade of the reflector 1 so that the projections 14 of the lock device 4 are disengaged from the recesses 13 on the flange of the bulb-holding base 5, and thus allow the bulb-holding base 5 to rotate. As the bulb-holding base 5 is rotated, the bulb 2 moves backwards and forwards with the bulb-holding base 5 under the guiding of the outer screw threads 12 of the bulb holder, so that the luminous point of the bulb 2 coincides with the focus of the parabolic lampshade to gain the optimal focusing effects. Subsequently, the lock device 4 coupled with the barrel portion 10 of the reflector 1 is slid toward the flange of the bulb-holding base 5 and the projections 14 of the lock device 4 are inserted into the recesses 13 on the flange of the bulb-holding base 5. Then, the lock device 4 is slightly rotated to move the protruding ribs 6 away from the position aligning with the narrow portion of the grooves 7. Thus, the lock device 4 can not move to and from on the reflector 1 and the positions of the bulb 2 and the reflector 1 can remain relatively fixed.

Figure 6:
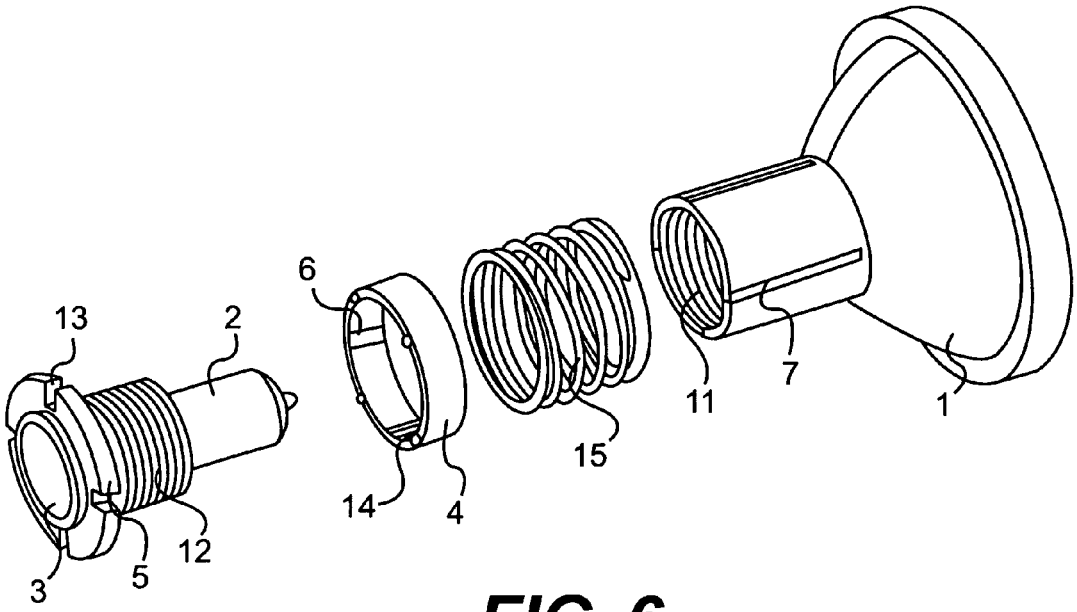
FIG. 6 is the perspective exploded view of the focusing flashlight according to another embodiment of the present invention, wherein only the reflector, the lock device and the bulb holder are shown.

FIG. 6 is an exploded view of the focusing flashlight according to this embodiment of the present invention, wherein only the reflector, the lock device and the bulb holder are shown. In this embodiment, the shape of the grooves 7 formed on the reflector 1 is different from that in the embodiments previously discussed, and the grooves 7 are straight grooves with a uniform width. In addition, a spring 15 around the barrel portion 10 of the reflector 1 is set between the lock device 4 and the reflector 1.

Figure 7:
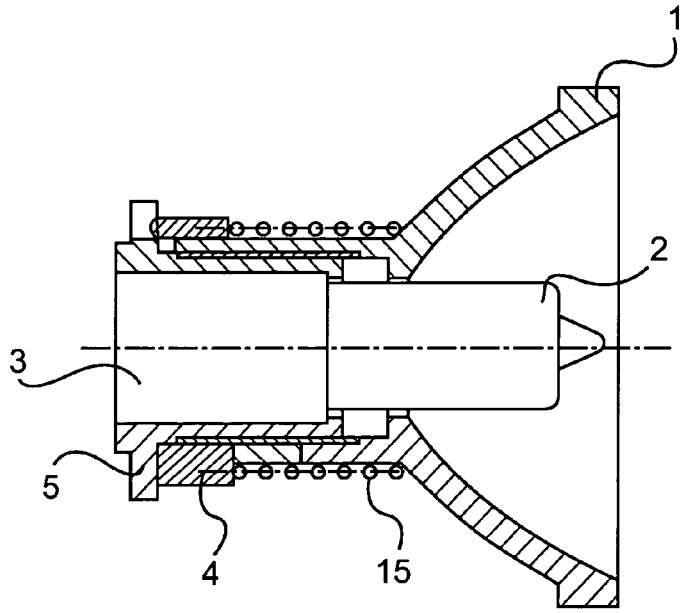
FIG. 7 shows schematically the assembly of the reflector, the lock device and bulb holder of FIG. 6.

FIG. 7 shows schematically the assembly of the reflector, the lock device 4 is kept in the recesses 13 on the flange of the bulb-holding base 5 under the action of the spring 15.

Figure 8:
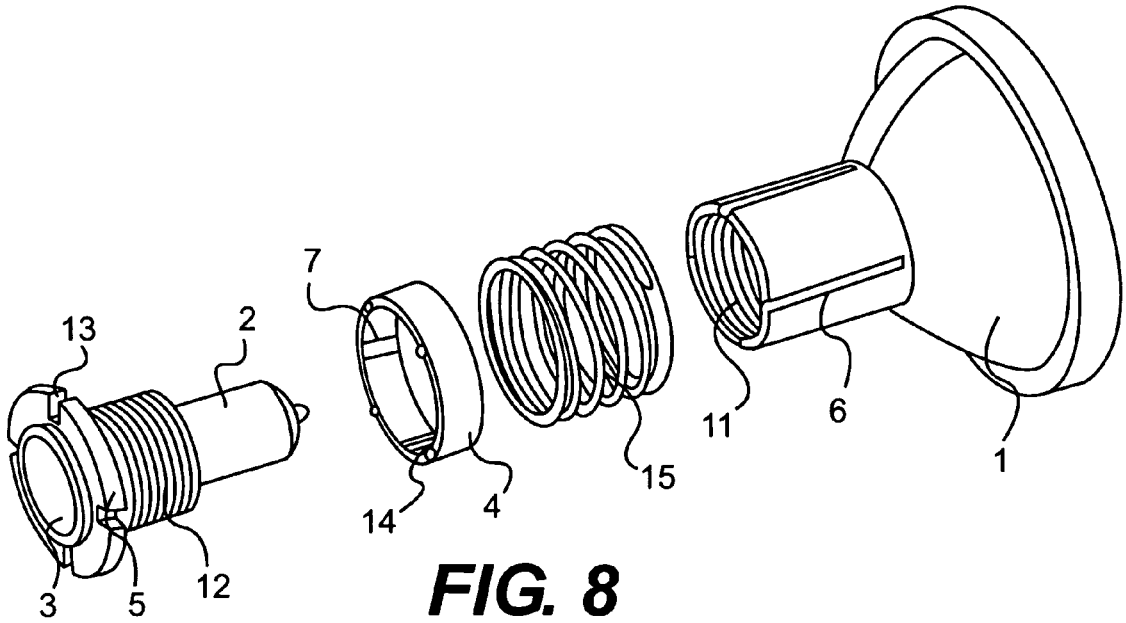
FIG. 8 is the perspective exploded view of the focusing flashlight according to another embodiment of the present invention, wherein only the reflector, the lock device and the bulb holder are shown.

FIG. 8 is an exploded view of the focusing flashlight according to yet another embodiment of the present invention, wherein only the reflector, the lock device and the bulb holder are shown. This embodiment is similar to another embodiment except that the positions of the protruding ribs 6 and the grooves 7 are different. In this embodiment, the protruding ribs 6 are formed in the axial direction on the outer wall of the barrel portion 10 of the reflector 1 at equal intervals, and the grooves 7 to be engaged with the protruding ribs 6 are formed on the inner wall of the lock device 4 at equal intervals in the circumference direction. The grooves 7 are also the straight grooves with a uniform width.

For the flashlights according to the embodiments of the present invention, focusing after the bulb 2 is installed, the lock device 4 coupled with the barrel portion 10 of the reflector 1 is firstly moved toward the lampshade of the reflector 1 with overcoming the elasticity of the spring 15, so that the projections 14 of the lock device 4 are disengaged from the recesses 13 on the flange of the bulb-holding base 5, thus enabling the bulb-holding base 5 to rotate. As the bulb-holding base 5 is rotated, the bulb 2 will move forwards and backwards with the bulb-holding base 5 under the guiding of the outer screw threads 12 of the bulb holder, thereby the luminous point of the bulb 2 coincides with the focus of the parabolic lampshade to gain the optimal focusing effects.

Then, the external force applied on the lock device 4 is released, and the lock device 4 moves toward the bulb-holding base 5 under the action of the elasticity of the spring 15, the projections 14 of the lock device 4 remains in the recesses 13 on the flange of the bulb-holding base 5. Thus, the lock device 4 cannot move to and from on the reflector 1 and the positions of the bulb 2 and the reflector 1 remain relatively fixed.

The present invention is not restricted by the above description. For instance, the said projections can be formed on the side of the flange of the bulb holder facing the lock device, while the said recesses can be formed on the said lock device. Those skilled in the art can make a lot of variations in the present invention without departing from the scope of the claims of the invention.

What is claimed is:

1. A focusing flashlight, comprising:

a housing body having a first end and a second end;

a bulb holder positioned at the first end of the housing body;

a bulb positioned in the bulb holder;

a tail cover mounted at the second end of the housing body;

a reflector connected to the bulb holder by a plurality of screw threads for adjusting the position of the bulb and having a barrel portion;

a lock device between the reflector and the bulb holder to fix the relative position of the reflector and the bulb holder; and a plurality of grooves elongated in an axial direction formed on an outer wall of the barrel portion of the reflector at equal intervals; wherein the lock device has a cylindrical part with protruding ribs formed on an inner wall thereof at equal intervals to be engaged with the grooves, and the lock device has projections formed on an end of the lock device facing the bulb holder at equal intervals; and wherein the bulb holder has a flange on an end of the bulb holder contacting the housing body and has a plurality of recesses formed on the flange for receiving the projections at equal intervals.

2. The focusing flashlight according to claim 1, wherein an inside diameter of the lock device is approximately equal to an outside diameter of the barrel portion of the reflector; wherein the grooves do not penetrate the wall of the barrel portion of the reflector; and wherein the depth of the grooves is approximately equal to the height of the protruding ribs.

3. The focusing flashlight according to claim 1, wherein the reflector has a lampshade portion and the width of the grooves formed on the outer wall of the barrel portion of the reflector is not uniform, with a portion of the grooves near the lampshade portion of the reflector being relatively narrower and a portion of the grooves near the bulb holder growing larger.

4. The focusing flashlight according to claim 1, wherein the width of the grooves on the outer wall of the barrel portion of the reflector is uniform, and a spring around the barrel portion of the reflector is provided between the lock device and the reflector.

5. The focusing flashlight according to claim 1, wherein the number of the grooves is the same as or an integral multiple of the number of the said protruding ribs.

6. The focusing flashlight according to claim 1, wherein the number of the recesses is the same as or an integral multiple of the number of the said projections.

7. A focusing flashlight, comprising:

a housing body having a first end and a second end;

a bulb holder positioned at the first end of the housing body;

a bulb positioned in the bulb holder;

a tail cover mounted at the second end of the housing body;

a reflector connected to the bulb holder by a plurality of screw threads for adjusting the position of the bulb and having a barrel portion;

a lock device between the reflector and the bulb holder to fix the relative position of the reflector and the bulb holder; and a plurality of grooves elongated in the axial direction formed on an outer wall of the barrel portion of the reflector at equal intervals; wherein the lock device has a cylindrical part with protruding ribs formed on an inner wall thereof at equal intervals to be engaged with the grooves, and the lock device has recesses formed on an end facing the bulb holder at equal intervals; and wherein the bulb holder has a flange on an end or the bulb holder contacting the housing body and the flange has a plurality of projections on a side thereof facing the lock device at equal intervals to be engaged with the recesses.

8. The focusing flashlight according to claim 7, wherein an inside diameter of the lock device is approximately equal to an outside diameter of the barrel portion of the reflector; wherein the grooves do not penetrate the wall of the barrel portion of the reflector; and wherein the depth of the grooves is approximately equal to the height of the protruding ribs.

9. The focusing flashlight according to claim 7, wherein the reflector has a lampshade portion and the width of the grooves formed on the outer wall of the barrel portion of the reflector is not uniform, with a portion of the grooves near the lampshade portion of the reflector being relatively narrower and a portion of the grooves near the bulb holder growing larger.

10. The focusing flashlight according to claim 7, wherein the width of the grooves on the outer wall of the barrel portion of the reflector is uniform, and a spring around the barrel portion of the reflector is provided between the lock device and the reflector.

11. The focusing flashlight according to claim 1, wherein the number of the grooves is the same as or an integral multiple of the number of the said protruding ribs.

12. The focusing flashlight according to claim 7, wherein the number of the recesses is the same as or an integral multiple of the number of the projections.

13. A focusing flashlight, comprising:

a housing body having a first end and a second end;

a bulb holder positioned at the first end of the housing body;

a bulb positioned in the bulb holder;

a tail cover mounted at the second end of the housing body;

a reflector connected to the bulb holder by a plurality of screw threads for adjusting the position of the bulb and having a barrel portion;

a lock device between the reflector and the bulb holder to fix the relative position of the reflector and the bulb holder; and a plurality of protruding ribs elongated in the axial direction formed on the outer wall of the barrel portion of the reflector at equal intervals, wherein the lock device has a cylindrical part with grooves formed on the inner wall thereof at equal intervals to be engaged with the protruding ribs, and having projections formed on an end of the lock device facing the bulb holder at equal intervals; and wherein the bulb holder has a flange on an end thereof contacting the housing body and the flange has a plurality of recesses for receiving the projections formed on the flange at equal intervals.

14. The focusing flashlight according to claim 13, wherein the inside diameter of the lock device is approximately equal to the outside diameter of the barrel portion of the reflector; wherein the grooves do not penetrate the wall of the lock device; and wherein the depth of the grooves is approximately equal to the height of the protruding ribs.

15. The focusing flashlight according to claim 13, wherein the reflector has a lampshade portion and the width of the grooves formed on the inner wall of the lock device is not uniform, with a portion of the grooves near the lampshade portion of the reflector being larger and a portion of the grooves near the bulb holder becoming smaller.

16. The focusing flashlight according to claim 13, wherein the width of the grooves formed on the inner wall of the lock device is uniform, and a spring around the barrel portion of the reflector is provided between the lock device and the reflector.

17. The focusing flashlight according to claim 13, wherein the number of the grooves is the same as or an integral multiple of the number of the said protruding ribs.

18. The focusing flashlight according to claim 13, wherein the number of the recesses is the same as or an integral multiple of the number of the projections.

19. A focusing flashlight, comprising:

a housing body having a first end and a second end;

a bulb holder positioned at the first end of the housing body;

a bulb positioned in the bulb holder;

a tail cover mounted at the second end of the housing body;

a reflector connected to the bulb holder by a plurality of screw threads for adjusting the position of the bulb and having a barrel portion;

a lock device between the reflector and the bulb holder to fix the relative position of the reflector and the bulb holder; and a plurality of protruding ribs elongated in the axial direction formed on the outer wall of the barrel portion of the reflector at equal intervals, wherein the lock device has a cylindrical part with grooves formed on the inner wall thereof at equal intervals to be engaged with the protruding ribs, and having recesses formed on an end of the lock device facing the bulb holder at equal intervals; and wherein the bulb holder has a flange on an end thereof contacting the housing body and the flange has a plurality of projections on an end thereof facing the lock device at equal intervals to be engaged with the recesses.

20. The focusing flashlight according to claim 19, wherein the inside diameter of the lock device is approximately equal to the outside diameter of the barrel portion of the reflector; wherein the grooves do not penetrate the wall of the lock device; and wherein the depth of the grooves is approximately equal to the height of the protruding ribs.

21. The focusing flashlight according to claim 19, wherein the width of the grooves formed on the inner wall of the lock device is not uniform, with the portion of the grooves near the lampshade of the reflector being larger and the portion of the grooves near the bulb holder becoming smaller.

22. The focusing flashlight according to claim 19, wherein the width of the grooves formed on the inner wall of the lock device is uniform, and a spring around the barrel portion of the reflector is provided between the lock device and the reflector.

23. The focusing flashlight according to claim 19, wherein the number of the grooves is the same as or an integral multiple of the number of the said protruding ribs.

24. The focusing flashlight according to claim 19, wherein the number of the recesses is the same as or an integral multiple of the number of the projections.

* * * * *